US006866944B2

(12) United States Patent
Nakazawa et al.

(10) Patent No.: US 6,866,944 B2
(45) Date of Patent: Mar. 15, 2005

(54) AUTOMOBILE FUEL CONTAINER MATERIAL EXCELLENT IN ENVIRONMENT COMPATIBILITY AND AUTOMOBILE FUEL CONTAINER

(75) Inventors: Makoto Nakazawa, Tokai (JP); Kenichiroh Matsumura, Tokai (JP); Ryoh Maruta, Tokai (JP); Yoshinobu Matsumura, Tokyo-To (JP); Shigeru Usuda, Tokyo-To (JP); Mitsuhiko Hirano, Tokyo-To (JP)

(73) Assignees: Nippon Steel Corporation, Tokyo-To (JP); Mitsubishi Jidosha Kogyo Kabushiki Kaisha, Tokyo-To (JP)

( * ) Notice: Subject to any disclaimer, the term of this patent is extended or adjusted under 35 U.S.C. 154(b) by 139 days.

(21) Appl. No.: 10/275,888

(22) PCT Filed: May 14, 2001

(86) PCT No.: PCT/JP01/03983

§ 371 (c)(1),
(2), (4) Date: Nov. 12, 2002

(87) PCT Pub. No.: WO01/86020

PCT Pub. Date: Nov. 15, 2001

(65) Prior Publication Data

US 2004/0089666 A1 May 13, 2004

(30) Foreign Application Priority Data

May 12, 2000 (JP) ..... 2000-140024

(51) Int. Cl.[7] ..... B32B 15/04; C23C 22/26; C23C 22/30

(52) U.S. Cl. ..... 428/626; 428/632; 428/659; 220/562; 220/567.2; 206/524.3

(58) Field of Search ..... 428/659, 632, 428/633, 626, 680; 206/524.3; 220/562, 567.2

(56) References Cited

U.S. PATENT DOCUMENTS

| | | | | | |
|---|---|---|---|---|---|
| 3,935,035 | A | * | 1/1976 | Tanaka et al. | 148/267 |
| 4,341,564 | A | * | 7/1982 | Schiffman | 106/453 |
| 4,966,634 | A | * | 10/1990 | Saeki et al. | 148/251 |
| 5,330,850 | A | * | 7/1994 | Suzuki et al. | 428/623 |
| 5,827,618 | A | * | 10/1998 | Oyagi et al. | 428/621 |
| 5,932,359 | A | * | 8/1999 | Nagai et al. | 428/621 |
| 6,143,422 | A | * | 11/2000 | Nagai et al. | 428/615 |
| 6,143,430 | A | * | 11/2000 | Miyasaka et al. | 428/659 |
| 6,361,881 | B1 | * | 3/2002 | Izaki et al. | 428/626 |
| 6,387,538 | B1 | * | 5/2002 | Lee et al. | 428/632 |
| 6,565,671 | B1 | * | 5/2003 | Lee et al. | 148/251 |
| 2004/0026667 | A1 | * | 2/2004 | Izaki et al. | 252/500 |

FOREIGN PATENT DOCUMENTS

| | | | |
|---|---|---|---|
| JP | 62-27587 | * | 2/1987 |
| JP | 62-37792 | * | 2/1987 |
| JP | 4-74872 | A | 3/1992 |
| JP | 10-183368 | A | 7/1998 |
| JP | 11-269663 | * | 10/1999 |
| JP | 11-269665 | * | 10/1999 |
| JP | 200-8176 | A | 1/2000 |

* cited by examiner

*Primary Examiner*—John J. Zimmerman
(74) *Attorney, Agent, or Firm*—Birch, Stewart, Kolasch & Birch, LLP

(57) ABSTRACT

An automobile fuel container material and container has good workability, corrosion resistance of internal and external surfaces and weldability. Excellent environmental adaptability arises from the material being free from the elution of harmful components such as lead and chromium(VI). The automobile fuel container material includes a steel sheet, 5 to 80 g/m$^2$ zinc plating as a first layer on at least one side of the surface of the steel sheet, 10 g/m$^2$ nickel plating as a second layer, and not more than 5 g/m$^2$ of a post-treatment layer. The post-treatment layer forms by coating partially reduced chromic acid and a reducing organic compound or can be an electrolytic chromate film as a lower layer and a resin as an upper layer.

14 Claims, 1 Drawing Sheet

AUTOMOBILE FUEL CONTAINER MATERIAL EXCELLENT IN ENVIRONMENT COMPATIBILITY AND AUTOMOBILE FUEL CONTAINER

This application is the national phase under 35 U.S.C. § 371 of PCT International Application No. PCT/JP01/03983 which has an International filing date of May 14, 2001, which designated the United States of America.

BACKGROUND OF THE INVENTION

1. Field of the Invention

The present invention relates to an automobile fuel container material and an automobile fuel container that are excellent in formability, weldability, corrosion resistance of a paint film, and corrosion resistance to gasoline and, at the same time, have improved (excellent) environmental adaptability, that is, are free from lead, which poses an environmental hygiene problem, and are free from the elution of chromium(VI).

2. Background Art

A terne plated steel sheet, which is a steel sheet plated with a lead-tin alloy having a tin content of 3 to 20% by weight, has hitherto been extensively used as an automobile fuel container material. This terne plated steel sheet is excellent in properties such as formability at the time of forming of the steel sheet into a fuel container, seam weldability, corrosion resistance of internal surface to a gasoline fuel, and corrosion resistance of external surface after painting. However, due to an increasing demand for global environmental protection in recent years, the terne plated steel sheet has become regarded as a problematic steel material. Specifically, there is an ever-increasing strong demand for the regulation of the elution of lead from industrial wastes such as shredder dust, and, since the terne plated steel plate, which is a steel plate plated with a lead-tin alloy, contains a large amount of lead, there is a tendency toward the restriction of the use of the terne plated steel sheet.

To cope with this, several steel plates with a lead-free plating have been developed and put to practical use as an alternative to the terne plated steel plate. For example, Japanese Patent Laid-Open No. 183368/1998 discloses a rust preventive steel sheet for a fuel tank wherein the surface of a steel sheet with a hot dip aluminum plating has been covered with a chromate film formed by coating, dipping, spraying or the like. This aluminum plated steel sheet, however, is expensive. Further, since a brittle iron-aluminum-silicon (Fe—Al—Si) alloy layer is formed at the interface of the steel sheet and the plating, the separation of the plating and cracking are likely to occur and the formability of this plated steel sheet is poor. In addition, harmful chromium(VI) is contained in the chromate film formed by coating, dipping, spraying or the like. Therefore, as with the case of lead, the aluminum plated steel sheet covered with the chromate film poses a problem that chromium(VI) is eluted from industrial wastes such as shredder dust.

SUMMARY OF THE INVENTION

The present invention has been made with a view to solving the above problems of the prior art, and it is an object of the present invention to provide an automobile fuel container material and an automobile fuel container, which are good in formability, corrosion resistance of the internal surface and the external surface, and weldability and, at the same time, are free from the elution of harmful components such as chromium(VI), that is, have excellent environmental adaptability, at low cost.

The present inventors have found that the deposition of a post treatment layer as the uppermost layer on a zinc plating and a nickel plating can realize the formation of a film as an undercoating for painting which is free from the elution of chromium(VI) and, at the same time, has excellent adhesion to the zinc plating or the nickel plating. This has led to the solution of the above problems of the prior art and the completion of the present invention.

Thus, according to the present invention, there is provided an automobile fuel container material having improved environmental adaptability, characterized by comprising: a steel sheet; a zinc plating as a first layer provided at a coverage of 5 to 80 g/m$^2$ on at least one side of the surface of the steel sheet; a nickel plating as a second layer provided at a coverage of not more than 10 g/m$^2$ on the zinc plating as the first layer; and a post-treatment layer as a third layer provided at a coverage of not more than 5 g/m$^2$ on the nickel plating as the second layer, the post-treatment layer having been formed by coating using partially reduced chromic acid and a reducing organic compound as essential components, the amount of the reducing organic compound being not less than the reduction equivalent of chromium(VI) in the partially reduced chromic acid. In this case, the post-treatment layer may have a structure comprising an electrolytic chromate film as a lower layer and a resin as an upper layer.

The zinc plating as the first layer may be a zinc-iron alloy plating having an iron content of not more than 25% by weight or a zinc-nickel alloy plating having a nickel content of not more than 25% by weight.

In the automobile fuel container material according to the present invention, the first, second, and third layers may be provided on either only one side or both sides of the steel sheet.

When the first, second, and third layers are provided on only one side of the steel sheet, the steel sheet may have, on its side remote from the first, second, and third layers, a zinc plating as a first layer provided at a coverage of 5 to 80 g/m$^2$ and a post-treatment layer as a second layer provided at a coverage of 0.1 to 5 g/m$^2$ on the zinc plating as the first layer, or alternatively the steel sheet may have, on its side remote from the first, second, and third layers, a plating of a zinc-iron alloy having an iron content of not more than 25% by weight as a first layer provided at a coverage of 5 to 80 g/m$^2$ and a post-treatment layer as a second layer provided at a coverage of 0.1 to 5 g/m$^2$ on the zinc-iron alloy plating as the first layer.

In another embodiment, the steel sheet has, on its side remote from the first, second, and third layers, a plating of a zinc-nickel alloy having a nickel content of not more than 25% by weight as a first layer provided at a coverage of 5 to 80 g/m$^2$ and a post-treatment layer as a second layer provided at a coverage of 0.1 to 5 g/m$^2$ on the zinc-nickel alloy plating as the first layer. In still another embodiment, a post-treatment layer is provided at a coverage of 0.1 to 5 g/m$^2$ directly on the surface of the steel sheet remote from the first, second, and third layers. In a further embodiment, the steel sheet has, on its side remote from the first, second, and third layers, none of a zinc plating, a nickel plating, and a post-treatment layer. That is, in this case, the surface of the steel sheet remote from the first, second, and third layers is kept in the original state.

As with the post-treatment layer in the steel sheet on its surface having the first, second, and third layers, the post-treatment layer provided on the surface of the steel sheet remote from the first, second, and third layers has preferably been formed by coating using partially reduced chromic acid and a reducing organic compound as essential components, the amount of the reducing organic compound being not less than the reduction equivalent of chromium(VI) in the partially reduced chromic acid, or alternatively has a two-layer structure comprising an electrolytic chromate film as a lower layer and a resin as an upper layer.

An automobile fuel container having excellent environmental adaptability can be produced using any one of the above steel sheets.

The automobile fuel container material having excellent environmental adaptability according to the present invention comprises: a steel sheet; a zinc plating as a first layer provided on at least one side of the surface of the steel sheet; a nickel plating as a second layer provided on the zinc plating as the first layer; and a post-treatment layer as a third layer provided on the nickel plating as the second layer. In this case, the post-treatment layer has been formed by coating using partially reduced chromic acid and a reducing organic compound as essential components, the amount of the reducing organic compound being not less than the reduction equivalent of chromium(VI) in the partially reduced chromic acid. Alternatively, the post-treatment layer has a two-layer structure comprising an electrolytic chromate film as a lower layer and a resin as an upper layer. According to the above construction, the automobile fuel container material is good in formability, corrosion resistance of the internal surface and the external surface, and weldability and, at the same time, are free from the elution of harmful components such as lead and chromium(VI). Therefore, an automobile fuel container having excellent environmental adaptability can be produced using this material.

DETAILED DESCRIPTION OF THE INVENTION

Figure 1:
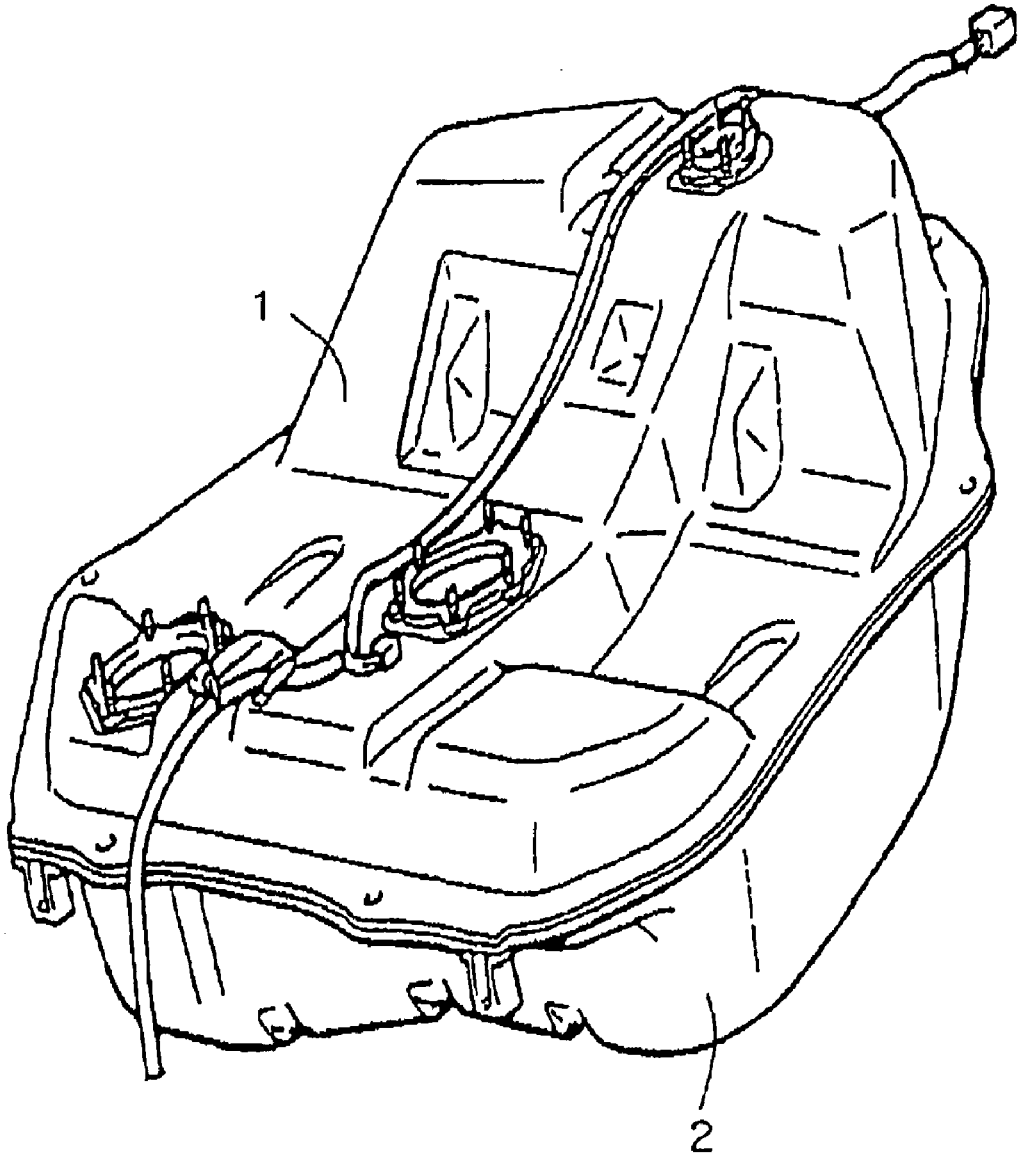
FIG. 1 is an outline diagram of an automobile fuel container, wherein numeral 1 designates a container upper and numeral 2 a container lower.

The automobile fuel container material having excellent environmental adaptability according to the present invention comprises a zinc plating as a first layer provided at a coverage of 5 to 80 g/m$^2$. The coverage of the zinc plating is limited to 5 to 80 g/m$^2$. When the coverage of the zinc plating is less than 5 g/m$^2$, the corrosion resistance of the internal and external surfaces of the fuel container is unsatisfactory. On the other hand, when the coverage of zinc plating exceeds 80 g/m$^2$, the press formability is deteriorated. The coverage of the zinc plating is more preferably 10 to 60 g/m$^2$. In the present invention, the zinc plating may be formed of zinc per se or a zinc alloy having a zinc content of not less than 75% by weight. When the zinc content is less than 75% by weight, the corrosion resistance is lowered. In the case of the zinc alloy plating, the use of a zinc-iron alloy having an iron content of not more than 25% by weight or a zinc-nickel alloy having a nickel content of not more than 25% by weight as the first layer can further improve the press formability and, in addition, can further improve the corrosion resistance of a paint film provided on the external surface of the fuel container.

In the zinc-iron alloy plating, when the iron content exceeds 25% by weight, the adhesion of the plating is lowered. Further, in this case, the formability is likely to be deteriorated. The iron content is more preferably 5 to 14% by weight.

In the zinc-nickel alloy plating, when the nickel content exceeds 25% by weight, the corrosion resistance and the formability are likely to be deteriorated. For this reason, the upper limit of the nickel content is 25% by weight. The nickel content is more preferably 7 to 14% by weight.

In the zinc plating according to the present invention, at least one element selected from Al (aluminum), Sb (antimony), C (carbon), Si (silicon), P (phosphorus), Sn (tin), Mg (magnesium), Mn (manganese), Ni (nickel), Cr (chromium), Co (cobalt), Cu (copper), Ca (calcium), Li (lithium), Ti (titanium), B (boron), and rare earth elements may be incorporated into the plating from the viewpoint of improving the corrosion resistance, adhesion of plating, formability and the like. As a matter of course, the zinc-iron alloy plating contains iron, and the zinc-nickel alloy plating contains nickel. In this case, zinc plating with elements other than the above elements being included therein as impurities causes no problem.

A nickel plating is provided as a second layer at a coverage of not more than 10 g/m$^2$ on the surface of the zinc plating as the first layer. When the coverage of the nickel plating exceeds 10 g/m$^2$, the effect of improving the corrosion resistance is saturated and, in some cases, the corrosion resistance is likely to be deteriorated. The coverage of the nickel layer is more preferably 1 to 7 g/m$^2$. The nickel plated surface of the steel sheet has excellent corrosion resistance to gasoline and, thus, is preferably used as the internal side of the fuel container.

In the present invention, the incorporation or inclusion of at least one element, selected from Al (aluminum), Sb (antimony), C (carbon), Si (silicon), P (phosphorus), Sn (tin), Mg (magnesium), Mn (manganese), Ni (nickel), Cr (chromium), Co (cobalt), Cu (copper), Ca (calcium), Li (lithium), Ti (titanium), B (boron), and rare earth elements, in the nickel plating causes no problem.

Further, the automobile fuel container material having excellent environmental adaptability according to the present invention comprises a post-treatment layer as a third layer at a coverage of not more than 5 g/m$^2$. The coverage of the post-treatment layer as the third layer is limited to not more than 5 g/m$^2$ for the following reason. When the coverage of the post-treatment layer exceeds 5 g/m$^2$, the effect of improving the adhesion to the zinc plating or the nickel plating is saturated and, in some cases, the adhesion to the zinc plating or the nickel plating is deteriorated. Preferably, the lower limit of the coverage of the post-treatment layer is 0.1 g/m$^2$, and the coverage of the post-treatment layer is in the range of 0.1 to 5 g/m$^2$.

The post-treatment layer is a layer formed by coating using partially reduced chromic acid and a reducing organic compound as essential components, that is, by performing the step of coating and step of drying. In this case, the amount of the reducing organic compound is not less than the reduction equivalent of chromium(VI) in the partially reduced chromic acid.

Here the partially reduced chromic acid refers to chromic acid produced by providing, for example, chromic anhydride having a chromium(VI) content of 100% by weight as a starting compound and reducing a part of chromium(VI) with starch, hydrogen peroxide, alcohol or the like to chromium(III).

The reducing organic compound refers to an organic compound containing a reducing functional group, such as an alcoholic hydroxyl group, a glycidyl group, an aldehyde group, or an alcohol amide group, and may be in the form of a monomer or a polymer. When the reducing organic compound is a monomer, however, a reduction reaction vigorously proceeds in a coating treatment bath and sometimes adversely affects the stability of the coating treatment bath. For this reason, the use of a polymer is preferred. The polymer may be any of water-soluble and water-dispersible polymers.

The amount of the reducing organic compound should be not less than the reduction equivalent of chromium(VI) in the partially reduced chromic acid. Chromium(VI) is reduced to chromium(III) by a reaction represented by formula (1):

$$Cr^{6+}+3OH^{-}\rightarrow Cr^{3+}+3/2H_2O+3/4O_2 \quad (1)$$

That is, when the ratio of the number of moles of the reducing functional group in the organic compound to the number of moles of chromium(VI) contained in the partially reduced chromic acid is 3 or more, upon the steps of coating and drying, chromium(VI) contained in the partially reduced chromic acid can be entirely reduced to chromium(III).

When the post-treatment layer as the third layer has a two-layer structure comprising an electrolytic chromate film as a lower layer and a resin layer as an upper layer, the elution of chromium(VI) can be suppressed. When the post-treatment layer having this two-layer structure is used as the internal surface of the fuel container, the corrosion resistance to gasoline possessed by nickel is not inhibited and rather could be somewhat improved. Therefore, good corrosion resistance of the internal surface can be ensured. On the other hand, when the post-treatment layer having this structure is used as the external surface of the fuel container, good adhesion of the resin layer to a topcoating formed on the resin layer and good adhesion of the electrolytic chromate film formed of chromium(III) to the zinc plating or the nickel plating can be ensured. By virtue of this, good corrosion resistance of the external surface can be ensured.

Electrolytic chromating is treatment wherein electrolysis is carried out using a plated steel sheet as a cathode in an aqueous solution of chromic anhydride having a chromium (VI) content of 100% by weight with a very small amount (about 100 ppm) of sulfuric acid added thereto to form a film of chromium(III) and the steel sheet is then washed with water. In the electrolytic chromate treatment, $e^-$ in formula (2) is electrically provided to reduce chromium(VI) to chromium(III).

$$Cr^{6+}+6e^{-}+3H^{+}\rightarrow Cr^{3+}+3/2H_2 \quad (2)$$

The resin is a water-soluble or water-dispersible resin, and resins usable herein include acrylic resin, urethane resin, epoxy resin, melamine-alkyd resin, and mixtures of these resins. Inorganic materials, such as silica, titania, and zirconia, polyethylene, Teflon, waxes such as stearic acid compounds, metal powder for improving weldability, and, further, crosslinking agents, leveling agents, antifoaming agents and the like may be added to these resins.

The steel sheet used in the present invention is composed mainly of Fe (iron) and further comprises at least one element, selected from C (carbon), Si (silicon), Mn (manganese), P (phosphorus), S (sulfur), Cu (copper), Ni (nickel), Cr (chromium), Mo (molybdenum), Co (cobalt), Al (aluminum), Nb (niobium), V (vanadium), Ti (titanium), Zr (zirconium), Hf (hafnium), Bi (bismuth), Sb (antimony), B (boron), N (nitrogen), O (oxygen), rare earth elements, Ca (calcium), and Mg (magnesium) according to properties required of the steel sheet and unavoidable impurities such as Sn (tin) and As (arsenic). Further, the thickness of the steel sheet used in the present invention is not particularly limited and may be a general value, for example, about 0.3 to 4 mm.

EXAMPLES

The present invention will be described in more detail with reference to the following examples.

Post-treatment layers A, B, C, and Z shown in Table 1 contained a partially reduced chromic acid and a reducing organic compound. Here an acrylic polymer produced by copolymerizing an alcoholic hydroxyl-containing hydroxyethyl acrylate (molecular weight 117) was used as the reducing organic compound.

The number of moles ($\alpha$) of chromium(VI) in the partially reduced chromic acid can be calculated from the total amount of chromium added in the form of the partially reduced chromic acid and the percentage reduction of chromium to chromium(III). On the other hand, the number of moles ($\beta$) of the reducing functional group can be calculated from the addition amount on a solid basis as the polymer, the proportion of hydroxyethyl acrylate as the reducing component, and the molecular weight of the reducing component.

In Table 1, three post-treatment layers A, B, and C are examples of the present invention wherein the molar ratio of the reducing organic compound to the partially reduced chromic acid is not less than 3 on a reduction equivalent basis. On the other hand, a post-treatment layer Z is a comparative example wherein the molar ratio is less than 3 on a reduction equivalent basis.

TABLE 1

| | Partially reduced chromic acid | | | Reducing organic compound | | | | |
|---|---|---|---|---|---|---|---|---|
| Post-treatment layer | Total amount of chromium added g/L | Percentage reduction of chromium % by weight | Number of moles ($\alpha$) of chromium(VI) mol/L | Addition amount on solid basis g/L | Proportion of reducing component % by weight | Molecular weight of reducing component | Number of moles ($\beta$) of reducing component mol/L | Molar ratio $\beta/\alpha$ |
| A | 7.8 | 80 | 0.0300 | 75 | 15 | 117 | 0.0962 | 3.2051 |
| B | 7.8 | 85 | 0.0225 | 75 | 15 | 117 | 0.0962 | 4.2735 |
| C | 7.8 | 85 | 0.0225 | 100 | 10 | 117 | 0.0855 | 3.7987 |
| Z | 7.8 | 60 | 0.0600 | 75 | 15 | 117 | 0.0962 | 1.6026 |

Post-treatment layers D and E shown in Table 2 had a structure comprising an electrolytic chromate as a lower layer and a resin as an upper layer. The resin in the post-treatment layer D was an acrylic resin to which silica and nickel powder had been added. The resin in the post-treatment layer E was a urethane resin to which silica and polyethylene had been added.

TABLE 2

| Post-treatment layer | Lower layer Type | Coverage of chromium mg/m$^2$ | Upper layer Type | Additive |
|---|---|---|---|---|
| D | Electrolytic chromate | 15 | Acrylic resin | Silica, Ni powder |
| E | Electrolytic chromate | 15 | Urethane resin | Silica, polyethylene wax |

A 1.0 mm-thick cold rolled steel sheet corresponding to JIS G 3141 SPCE was provided as a material under test. A plating and a post-treatment layer shown in Table 3 were provided on the surface of the steel sheet. In Table 3, Zn represents the deposition of a plating by galvanizing (hot dip zinc coating), Zn (EG) represents the deposition of a plating by electrogalvanizing, Zn-15% Fe represents the deposition of a plating by alloyed galvanizing, Zn-12% Ni represents the deposition of a plating by electrolytic zinc-nickel alloy plating, and Ni represents the deposition of a plating by electrolytic nickel plating.

Test pieces were extracted from steel sheets, on which various platings and post-treatment layers had been deposited, and were subjected to various tests. Specifically, a chromium(VI) elution test, a paint film durability test, an anti-corrosion test for gasoline, a formability test, and a weldability test were carried out by the following methods. The results are shown in Table 4.

<Elution of Chromium(VI)>

A test piece was taken off so that the total surface area of the post-treatment layer was 300 cm$^2$. The test piece was immersed in 500 cc of pure water which was then heated and boiled and kept in this state for 30 min. Thereafter, water in an amount lost by the evaporation was added to again bring the volume of the water to 500 cc, followed by coloring analysis of the water to determine chromium(VI) by a diphenylcarbazide method. When chromium(VI) was not detected by the microanalysis (detection limit 0.03 ppm), the elution of chromium(VI) was evaluated as ○, while when chromium(VI) was detected by the microanalysis, the elution of chromium(VI) was evaluated as X.

<Durability of Paint Film>

In order to examine the durability of a paint film provided on the external surface of the fuel container, a test piece having a size of 150 cm×50 cm was extracted by cutting. A melamine alkyd resin-based paint free from chromium(VI) as a pigment was coated to a thickness of 20 $\mu$m, and the coating was dried, followed by a corrosion resistance test, a water resisting adhesion test, and an impact resistance test.

In the corrosion resistance test, according to JASO M 609-91, crosscuts were provided in the test piece, and a cycle corrosion test (CCT) was then carried out by 90 cycles. In this case, the salt water concentration was 0.5% by weight. After the completion of the test, a tape was applied to the crosscut portions and was then separated from the crosscut portions, and the separation width was determined. The results were evaluated according to the following criteria.

◎: One-side separation width of less than 1 mm

○: One-side separation width of not less than 1 mm and less than 3 mm

Δ: One-side separation width of not less than 3 mm and less than 5 mm

X: One-side separation width of not less than 5 mm

In the water resisting adhesion test, the test piece was immersed in pure water of 40° C. for 120 hr. Thereafter, grid-like slashes were provided at intervals of 1 mm, followed by a tape peel test. The results were evaluated according to the following criteria.

◎: No portion separated

○: Less than 5 portions separated

Δ: 5 to less than 20 portions separated

X: Not less than 20 portions separated

In the impact resistance test, the test piece was horizontally fixed, and a 500-g steel weight having a head diameter of 6.3 mmϕ was repeatedly gravity dropped ten times from a height of 20 cm to determine the number of separated coating pieces. The results were evaluated according to the following criteria.

○: No coating separated

Δ: 3 or less separated coating pieces

X: Not less than 4 separated coating pieces

<Corrosion Resistance to Gasoline>

In the test on corrosion resistance to gasoline, the test piece was punched to form a circular plate. The circular plate was formed into a cylinder having an inner diameter of 50 mm and a depth of 35 mm so that one side described as internal surface in Table 3 constituted the internal surface (gasoline side). Next, the inside of the cylinder was filled with any one of the following two corrosion test liquids, and the cylinder was hermetically sealed and, in this state, was kept at 30° C. for 2 months.

Corrosion test liquid 1

Water: 1.0 vol %

Gasoline: Balance

Corrosion test liquid 2

Water: 1.0 vol %

Formic acid: 0.1 g/L

Ethanol: 30 vol %

NaCl: 0.05 g/L

Gasoline: Balance

After the completion of the test, the inside of the cylinder was inspected for corrosion. The results were evaluated according to the following criteria.

◎: Not corroded at all

○: Slightly corroded

Δ: Partially corroded

X: Corroded over whole area

<Formability>

In the formability test, the test piece was punched to form a 180-ϕ circular plate which was then formed into a cylinder using a punch having a head diameter of 40 mm and a die provided with lock beads at an ear pressing pressure of 20 kN to determine the forming height. The results were evaluated according to the following criteria.

◎: Forming height of not less than 50 mm (drawn through with no fracture)

○: Forming height of not less than 43 mm and less than 50 mm

Δ: Forming height of not less than 37 mm and less than 43 mm

X: Forming height of less than 37 mm

<Weldability>

Two test pieces were put on top of each other so that the internal surface in one of the test pieces faced the internal surface in the other test piece, and seam welding was carried out using a copper electrode. The welding current was 20 kA, the welding speed was 3 m/min, and the welding length was 50 cm. The bead portion was subjected to X-ray inspection for flaws. As a result, for all the samples shown in Table 1, cracking was not observed.

TABLE 3

| | External surface (paint film side) | | | | | | Internal surface (gasoline side) | |
|---|---|---|---|---|---|---|---|---|
| | Zinc plating | | Nickel plating | | Post-treatment layer | | Zinc plating | |
| Test No. | Composition | Coverage, g/m$^2$ | Composition | Coverage, g/m$^2$ | Type | Coverage, g/m$^2$ | Composition | Coverage, g/m$^2$ |
| 1 | Zn | 50 | Ni | 3 | A | 0.4 | Zn | 50 |
| 2 | Zn—15% Fe | 45 | Ni | 5 | B | 1.0 | Zn—15% Fe | 45 |
| 3 | Zn—12% Ni | 40 | Ni | 5 | C | 0.5 | Zn—12% Ni | 4 |
| 4 | Zn | 50 | — | — | D | 1.2 | Zn | 50 |
| 5 | Zn—15% Fe | 40 | — | — | E | 1.0 | Zn—15% Fe | 40 |
| 6 | Zn—15% Fe | 45 | — | — | B | 1.0 | Zn | 45 |
| 7 | Zn—12% Ni | 45 | — | — | E | 1.5 | Zn | 45 |
| 8 | Zn(EG) | 40 | Ni | 3 | D | 0.7 | Zn(EG) | 40 |
| 9 | — | — | — | — | E | 1.5 | Zn(EG) | 40 |
| 10 | Zn(EG) | 40 | Ni | 3 | A | 0.4 | — | — |
| 11 | Zn(EG) | 40 | Ni | 3 | E | 1.5 | — | — |
| 12 | Zn | 45 | Ni | 3 | Z | 0.7 | Zn | 45 |
| 13 | Ni—10% Zn | 20 | — | — | — | — | Ni—10% Zn | 20 |
| 14 | Pb—10% Sn | 60 | — | — | — | — | Pb—10% Sn | 60 |
| 15 | Zn | 50 | — | — | Coated chromate | Cr = 60 mg/m$^2$ | Zn | 50 |
| 16 | Al—10% Si | 60 | — | — | Coated chromate | Cr = 60 mg/m$^2$ | Al—10% Si | 60 |

| | Internal surface (gasoline side) | | | | |
|---|---|---|---|---|---|
| | Nickel plating | | Post-treatment layer | | |
| Test No. | Composition | Coverage, g/m$^2$ | Type | Coverage, g/m$^2$ | Remarks |
| 1 | Ni | 3 | A | 0.4 | Ex. |
| 2 | Ni | 5 | B | 1.0 | Ex. |
| 3 | Ni | 5 | C | 0.5 | Ex. |
| 4 | Ni | 3 | D | 2.5 | Ex. |
| 5 | Ni | 3 | E | 1.0 | Ex. |
| 6 | Ni | 3 | B | 1.0 | Ex. |
| 7 | Ni | 3 | E | 2.5 | Ex. |
| 8 | Ni | 3 | D | 2.5 | Ex. |
| 9 | Ni | 6 | E | 1.5 | Ex. |
| 10 | — | — | D | 4.5 | Ex. |
| 11 | Ni | 5 | E | 1.5 | Ex. |
| 12 | Ni | 3 | Z | 0.7 | Comp. Ex. |
| 13 | — | — | — | — | Comp. Ex. |
| 14 | — | — | — | — | Comp. Ex. |
| 15 | — | — | Coated chromate | Cr = 60 mg/m$^2$ | Comp. Ex. |
| 16 | — | — | Coated chromate | Cr = 60 mg/m$^2$ | Comp. Ex. |

TABLE 4

| | | Durability of paint film (external surface) | | | Corrosion resistance to gasoline (internal surface) | | | |
|---|---|---|---|---|---|---|---|---|
| Test No. | Elution of chromium(VI) | Corrosion resistance (cct) | Water resisting adhesion | Impact resistance | Corrosion test liquid 1 | Corrosion test liquid 2 | Formability | Remarks |
| 1 | ○ | ○ | ○ | ○ | ○ | ○ | ○ | Ex. |
| 2 | ○ | ○ | ○ | ○ | ○ | ○ | ○ | Ex. |
| 3 | ○ | ○ | ○ | ○ | ○ | ○ | ○ | Ex. |
| 4 | ○ | ○ | ○ | ○ | ○ | ○ | ○ | Ex. |
| 5 | ○ | ◎ | ○ | ○ | ○ | ○ | ○ | Ex. |
| 6 | ○ | ◎ | ○ | ○ | ○ | ○ | ○ | Ex. |
| 7 | ○ | ○ | ○ | ○ | ○ | ○ | ○ | Ex. |
| 8 | ○ | ○ | ○ | ○ | ○ | ○ | ○ | Ex. |
| 9 | ○ | Δ | ○ | ○ | ○ | ○ | ○ | Ex. |
| 10 | ○ | ○ | ○ | ○ | ○ | ○ | ○ | Ex. |
| 11 | ○ | ○ | ○ | ○ | ○ | ○ | ○ | Ex. |
| 12 | x | ○ | ○ | ○ | ○ | ○ | ○ | Comp. Ex. |
| 13 | ○ | x | Δ | x | ○ | ○ | x | Comp. Ex. |
| 14 | ○ | ◎ | ○ | ○ | ○ | x | ○ | Comp. Ex. |
| 15 | x | ○ | Δ | ○ | ○ | x | ○ | Comp. Ex. |
| 16 | x | Δ | ○ | Δ | ○ | ○ | ○ | Comp. Ex. |

In Table 4, for test No. 12 wherein a post-treatment layer Z shown in Table 1, wherein the molar ratio of the reducing functional group to chromium(VI) was less than 3 on a reduction equivalent basis, was used, the elution of chromium(VI) exceeded 0.03 ppm.

For test No. 13 which was not provided with any post-treatment layer, the durability of a paint film on the external surface was poor, and the formability was also poor.

For test No. 14 wherein conventional lead-10% tin alloy plating was provided and no post-treatment layer was provided, the presence of the large amount of lead poses an environmental problem, and, in addition, the corrosion resistance to gasoline was poor.

For test Nos. 15 and 16 wherein coated chromate was provided as the post-treatment layer, due to the presence of a large amount of chromium(VI) in the coated chromate, chromium(VI) in an amount of more than 0.03 ppm was eluted.

Against the above comparative examples, for the test Nos. 1 to 11 which are examples of the present invention wherein a zinc plating, a nickel plating, and a post-treatment layer were provided on at least one side of the steel sheet, elution of chromium(VI) did not occur, the external surface had excellent durability of a paint film, and the internal surface had excellent corrosion resistance to gasoline, and the formability was also good.

Among the tests shown in Table 3, steel sheets of test Nos. 1, 2, 4, 5, and 6, which are examples of the present invention, and steel sheets of test Nos. 14, 15, and 16, which are comparative examples, were provided. Using each of these steel sheets, a container upper 1 and a container lower 2 as shown in FIG. 1 were produced by cold forming. The container upper 1 was then welded to the container lower 2, and a melamine-alkyd resin was coated onto the external surface to a thickness of 20 $\mu$m to prepare an automobile fuel container. For the steel sheet of each test number, five automobile fuel containers were produced. The production of the automobile fuel containers was carried out in a conventional mass production line, and, in this case, the automobile fuel containers were inspected for defects. The inside of the automobile fuel containers was filled with the above corrosion test liquid 1 or 2, and the automobile fuel containers were then exposed to an environment of a place along the sea in Okinawa for one year to examine the corrosion resistance of a paint film on the external surface and the corrosion resistance of the internal surface to gasoline. The results were evaluated according to the following criteria. The results of evaluation are shown in Table 5.

○: Very slightly corroded

Δ: Partially corroded

X: Corroded over whole area

In Table 5, for test No. 14, in the test using a corrosion test liquid 2, the corrosion occurred over the whole area, indicating that the corrosion resistance to gasoline was poor.

For test No. 15, as with for test No. 14, in the test using a corrosion test liquid 2, the corrosion occurred over the whole area, indicating that the corrosion resistance to gasoline was poor. Further, also in the external surface, corrosion partially occurred, indicating that the corrosion resistance of a paint film was somewhat poor.

For test No. 16, poor weld occurred, indicating that the mass productivity was poor. Further, also in the external surface, corrosion partially occurred, indicating that the corrosion resistance of a paint film was somewhat poor.

Against the above comparative examples, for all of test Nos. 1, 2, 4, 5, and 6, the corrosion level of the external surface and the internal surface was very low, indicating that the corrosion resistance of a paint film and the corrosion resistance to gasoline were excellent. Further, the mass productivity was excellent.

Effect of the Invention

As described above, the automobile fuel container material and automobile fuel container possessing excellent environmental adaptability according to the present invention are good in workability, corrosion resistance of internal surface and external surface, and weldability, and are free from elution of harmful components such as lead and chromium(VI). Further, the adoption of a plating composed mainly of zinc, which is more inexpensive than aluminum and tin, as the first layer can realize mass production of automobile fuel container materials and automobile fuel containers at low cost.

Thus, the present invention is very useful from the viewpoint of industry.

What is claimed is:

1. An automobile fuel container material having improved environmental adaptability, comprising:

a steel sheet;

a zinc plating as a first layer provided at a coverage of 5 to 80 g/m$^2$ on at least one side of the surface of the steel sheet;

a nickel plating as a second layer provided at a coverage of not more than 10 g/m$^2$ on the zinc plating as the first layer; and a post-treatment layer as a third layer provided at a coverage of not more than 5 g/m$^2$ on the nickel plating as the second layer, the post-treatment layer having been formed by coating using partially reduced chro-

TABLE 5

| Test No. | Mass productivity | Corrosion resistance of paint film (external surface) | Corrosion resistance to gasoline (internal surface) Corrosion test liquid 1 | Corrosion test liquid 2 | Remarks |
|---|---|---|---|---|---|
| 1 | ○ | ○ | ○ | ○ | Ex. |
| 2 | ○ | ○ | ○ | ○ | Ex. |
| 4 | ○ | ○ | ○ | ○ | Ex. |
| 5 | ○ | ○ | ○ | ○ | Ex. |
| 6 | ○ | ○ | ○ | ○ | Ex. |
| 14 | ○ | ○ | ○ | x | Comp. Ex. |
| 15 | ○ | Δ | ○ | x | Comp. Ex. |
| 16 | x Poor weld | Δ | ○ | ○ | Comp. Ex. |

mic acid and a reducing organic compound as essential components, the amount of the reducing organic compound being not less than the reduction equivalent of chromium(VI) in the partially reduced chromic acid, and a ratio of a number of moles of the reducing functional group in the reducing organic compound to a number of moles of chromium (VI) contained in the partially reduced chromic acid being 3 or more.

2. An automobile fuel container material having improved environmental adaptability, comprising:

a steel sheet;

a zinc plating as a first layer provided at a coverage of 5 to 80 g/m$^2$ on at least one side of the surface of the steel sheet;

a nickel plating as a second layer provided at a coverage of not more than 10 g/m$^2$ on the zinc plating as the first layer; and a post-treatment layer as a third layer provided at a coverage of not more than 5 g/m$^2$ on the nickel plating as the second layer, the post-treatment layer having a structure comprising an electrolytic chromate film as a lower layer and a resin as an upper layer.

3. The automobile fuel container material having improved environmental adaptability according to claim 1 or 2, wherein the zinc plating as the first layer is a plating of a zinc-iron alloy having an iron content of not more than 25% by weight.

4. The automobile fuel container material having improved environmental adaptability according to claim 1 or 2, wherein the zinc plating as the first layer is a plating of a zinc-nickel alloy having a nickel content of not more than 25% by weight.

5. The automobile fuel container material having improved environmental adaptability according to any one of claims 1 or 2, wherein the first, second, and third layers are provided on both sides of the steel sheet.

6. The automobile fuel container material having improved environmental adaptability according to claim 1 or 2, wherein the first, second, and third layers are provided on only one side of the steel sheet.

7. The automobile fuel container material having improved environmental adaptability according to claim 6, wherein the steel sheet has, on its side remote from the first, second, and third layers, a zinc plating as a first layer provided at a coverage of 5 to 80 g/m$^2$ and a post-treatment layer as a second layer provided at a coverage of 0.1 to 5 g/m$^2$ on the zinc plating as the first layer.

8. The automobile fuel container material having improved environmental adaptability according to claim 6, wherein the steel sheet has, on its side remote from the first, second, and third layers, a plating of a zinc-iron alloy having an iron content of not more than 25% by weight of iron as a first layer provided at a coverage of 5 to 80 g/m$^2$ and a post-treatment layer as a second layer provided at a coverage of 0.1 to 5 g/m$^2$ on the zinc-iron alloy plating as the first layer.

9. The automobile fuel container material having improved environmental adaptability according to claim 6, wherein the steel sheet has, on its side remote from the first, second, and third layers, a plating of a zinc-nickel alloy having a nickel content of not more than 25% by weight of nickel as a first layer provided at a coverage of 5 to 80 g/m$^2$ and a post-treatment layer as a second layer provided at a coverage of 0.1 to 5 g/m$^2$ on the zinc-nickel alloy plating as the first layer.

10. The automobile fuel container material having improved environmental adaptability according to claim 6, wherein the steel sheet has, on its side remote from the first, second, and third layers, a nickel plating provided at a coverage of not more than 10 g/m$^2$ and a post-treatment layer provided at a coverage of 0.1 to 5 g/m$^2$ on the nickel plating.

11. The automobile fuel container material having improved environmental adaptability according to claim 6, wherein the steel sheet has, on its side remote from the first, second, and third layers, a post-treatment layer provided at a coverage of 0.1 to 5 g/m$^2$.

12. The automobile fuel container material having improved environmental adaptability according to claim 7, wherein the post-treatment layer provided on the surface of the steel sheet remote from the first, second, and third layers has been formed by coating using partially reduced chromic acid and a reducing organic compound as essential components, the amount of the reducing organic compound being not less than the reduction equivalent of chromium (VI) in the partially reduced chromic acid.

13. The automobile fuel container material having improved environmental adaptability according to claim 7, wherein the post-treatment layer provided on the surface of the steel sheet remote from the first, second, and third layers has a structure comprising an electrolytic chromate film as a lower layer and a resin as an upper layer.

14. An automobile fuel container formed of the automobile fuel container material having improved environmental adaptability according to any one of claims 1 or 2.

* * * * *